US005899608A

United States Patent [19]

Eklund et al.

[11] Patent Number: 5,899,608

[45] Date of Patent: May 4, 1999

[54] ION CHARGING DEVELOPMENT SYSTEM TO DELIVER TONER WITH LOW ADHESION

[75] Inventors: Elliott A. Eklund, Penfield; Yelena Shapiro, Rochester; Dan A. Hays, Fairport, all of N.Y.

[73] Assignee: Xerox Corporation, Stamford, Conn.

[21] Appl. No.: 09/036,731

[22] Filed: Mar. 9, 1998

[51] Int. Cl.[6] ..... G03G 15/08

[52] U.S. Cl. ..... 399/266; 399/290; 399/292

[58] Field of Search ..... 399/266, 290, 399/291, 292, 293

[56] References Cited

U.S. PATENT DOCUMENTS

| | | | |
|---|---|---|---|
| 3,759,222 | 9/1973 | Maksymiak et al. | 399/285 |
| 4,030,446 | 6/1977 | Karr | 399/290 |
| 4,777,106 | 10/1988 | Fotland et al. | 430/120 |
| 5,339,142 | 8/1994 | Hays | 399/266 X |
| 5,360,940 | 11/1994 | Hays | 399/266 |
| 5,386,277 | 1/1995 | Hays et al. | 399/291 X |
| 5,532,100 | 7/1996 | Christy et al. | 430/120 |
| 5,734,955 | 3/1998 | Gruber et al. | 399/266 |
| 5,734,956 | 3/1998 | Matalevich | 399/291 |
| 5,742,885 | 4/1998 | Wayman | 399/293 |

*Primary Examiner*—Sandra Brase

[57] ABSTRACT

Interdigitated electrodes on a donor roll enable uncharged toner to be picked up from a fluidized bed reservoir. This layer of toner is subsequently charged by exposure to a corona device and delivered to a development zone, where it is used to develop an electrostatic latent image. Residual toner on the donor is neutralized by exposure to a second corona device and then stripped for return to the fluidized bed by applying an AC voltage between adjacent donor electrodes. So-called ion charging of the toner is known to cause the particles to have low adhesion, allowing development with DC fields alone. Optionally, an AC voltage can also be applied to adjacent donor electrodes in the development zone to enhance particle release. In addition to providing a means to impart adequate flow to the toner in this single component development system, the fluidized bed reservoir, in conjunction with ion charging, also provides a means for blending dry powder toners to achieve custom color development.

12 Claims, 3 Drawing Sheets

ION CHARGING DEVELOPMENT SYSTEM TO DELIVER TONER WITH LOW ADHESION

BACKGROUND OF THE INVENTION

This invention relates generally to a development apparatus for ionographic or electrophotographic imaging and printing apparatuses and machines, and more particularly is directed to a process of loading the surface of an interdigitated electroded donor roll with uncharged toner particles, subsequently corona charging the toner, and forming a toner cloud in a development zone.

Generally, the process of electrophotographic printing includes charging a photoconductive member to a substantially uniform potential so as to sensitize the surface thereof. The charged portion of the photoconductive surface is exposed to a light image from either a scanning laser beam, an LED array or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two component, in which the developer material is comprised of magnetic carrier granules having toner particles adhering triboelectrically thereto and single component, which typically uses toner only. The development system disclosed herein is of the latter, or single component, type. Toner particles are attracted to the latent image forming a toner powder image on the photoconductive surface The toner powder image is subsequently transferred to a copy sheet, and finally, the toner powder image is heated to permanently fuse it to the copy sheet in image configuration.

The adhesion of charged toner particles in large part determines the operating latitude of powder xerographic development systems. It has been found that triboelectrically charged toner has high electrostatic adhesion, due to non-uniform surface charge distributions and localized regions of high surface charge density on the toner particles. The high adhesion of tribo-charged toner severely restricts the operating latitude of powder development systems, particularly those in which a toner cloud is generated to develop the latent image.

For powder xerography, the image quality requirements make it necessary to reduce the toner particle size to around 5 microns or less in diameter. For printers serving the color offset printing markets, the development system requires high quality, high speed and robust toner delivery. The ability to blend different color toners to achieve custom colors is another requirement. Unfortunately, traditional powder development systems based on triboelectric toner charging do not appear to have the operating latitude necessary to simultaneously satisfy all of these requirements. As will be demonstrated below, however, the use of an ion charging-based development system potentially enables the extended capabilities required for high quality production color printing with dry powder.

The operating latitude of a powder xerographic development system is determined to a great degree by the ease with which toner particles are supplied to an electrostatic image. Placing charge on the particles, to enable movement and imagewise development via electric fields, is most often accomplished with triboelectricity. However, all development systems which use triboelectricity to charge toner, whether they be two component (toner and carrier) or monocomponent (toner only), have one feature in common: charges are distributed non-uniformly on the surface of the toner. This results in high electrostatic adhesion due to locally high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, tribo-charged particles much more difficult to develop and control.

Jumping development systems, in which toner is required to jump a gap to develop the electrostatic latent image, are capable of image quality which can be superior to in-contact systems, such as magnetic brush development. Unfortunately, they are also much more sensitive to toner adhesion. In fact, high toner adhesion has been identified as a major limitation in jumping development. Up to now, mechanical and/or electrical agitation of toner have been used to break these adhesion forces and allow toner to be released into a cloud for jumping development. This approach has had limited success, however. More agitation often releases more toner, but high adhesion due to triboelectric charging still dominates in toner cloud generation and causes unstable development. For full color printing system architectures in which the complete image is formed on the image bearing member, an increase in toner delivery rate produces a highly interactive toner cloud, which disturbs previously developed particles on the latent image. This erases many of the original benefits of jumping development for color xerographic printing for the so-called image-on-image (IOI) architecture. Again, as the toner size is reduced, the above limitations become even more acute due to increased toner adhesion.

Given that charged particle adhesion is a major limiting factor in development with dry powder, it has been a goal to identify toner charging and delivery schemes which keep toner adhesion low. Clearly, the adhesion of the charged toner depends sensitively on the method used to charge the particles. Triboelectric charging is known to produce highly adhering particles. On the other hand, ion toner charging, which occurs when toner particles capture ions emitted by a nearby corona device, results in a more uniform deposition of charge on the particle's surface, and thus lowers the adhesion of the particles for a given charge level.

It is well known that fluidizing reservoirs, commonly referred to as fluidized beds, provide a means for storing, mixing and transporting toner in certain single component development systems. Efficient means for fluidizing toner and charging the particles within the fluidized bed are disclosed in U.S. Pat. No. 4,777,106 and U.S. Pat. No. 5,532,100, which are hereby incorporated by reference. In these disclosures, corona devices are embedded in the fluidized toner for simultaneous toner charging and deposition onto a receiver roll. While the development system as described has been found satisfactory in some development applications, it leaves something to be desired in the way in applications requiring the blending of two or more dry powder toners to achieve custom color development. Also, it has been found in the above systems that there are frequently disturbances to the flow in the fluidized bed associated with charged particles in the high electric fields surrounding corona devices immersed in the reservoir. Finally, it is known that residual toner left on the donor roll after development contributes to non-uniformities in subsequently loaded toner layers, thereby leading to the so-called "ghosting" defect in printed images.

Briefly, the present invention obviates the problems noted above by enabling a gentle toner handling system in which non-contact metering and particle charging on an electroded donor roll can be controlled independently to provide charged toner particles with low adhesion for xerographic development. The toner is initially extracted electrostatically from a fluidized bed and deposited as a net neutral layer on a donor member. This toner layer is subsequently charged with a DC or AC corona device and delivered to a latent image. This so-called ion charging produces a more uniform deposition of charge on the toner particles, resulting in significantly lowered particle adhesion. In addition, the ion charging process is independent of toner pigment, allowing mixtures of two of more different colored toners to be charged homogeneously. Residual toner on the donor is neutralized and returned to the fluidized bed toner reservoir during each complete cycle of the donor roll.

There is also provided an apparatus for developing a latent image recorded on an imaging surface, comprising; a housing defining a reservoir storing a supply of developer material comprising toner; means for fluidizing said developer material in the chamber of said housing; a donor member, mounted partially in said chamber and spaced from the imaging surface, for transporting toner on an outer surface said donor member to a region opposed from the imaging surface, said toner donor member having a plurality of electrodes positioned near the outer surface of donor member; means for electrical biasing a portion of said electrode members on a region of said donor member positioned in close proximity to said fluidized toner so as to electrostatically load toner onto the region of the donor member; means for ion charging said toner loaded on the region of said donor member; means for electrical biasing said electrode members positioned in close proximity to said imaging member to detach toner from said region of said donor member as to form a toner cloud for developing the latent image; and means for discharging and removing residual toner on the region of said donor and returning said toner to the reservoir.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

In as much as the art of electrophotographic printing is well known, the various processing stations employed in the FIG. 3 printing machine will be shown hereinafter schematically and their operation described briefly with reference thereto.

Figure 3:
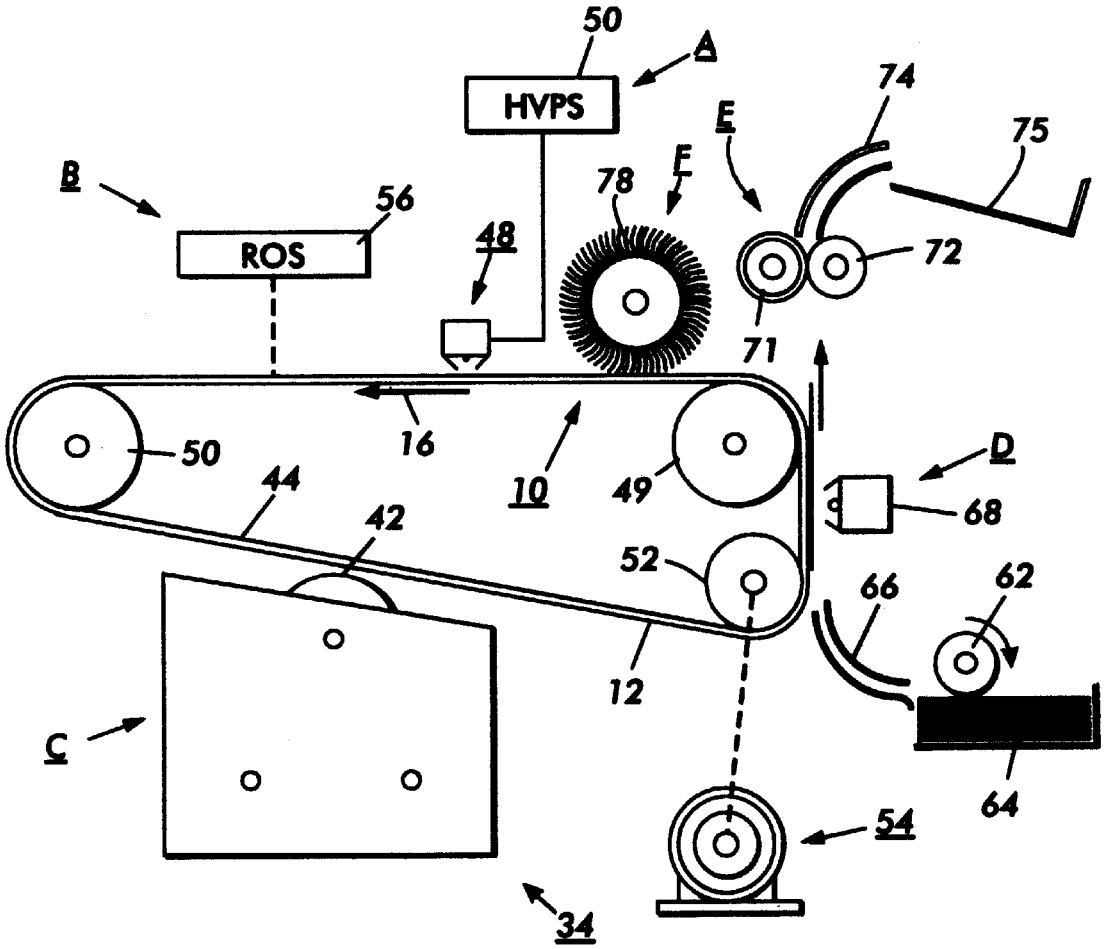
FIG. 3 is a schematic elevational view of an illustrative electrophotographic printing machine incorporating the present invention therein.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 44. Preferably the surface 12 is made from a selenium alloy. The substrate is preferably made from an aluminum alloy or a suitable photosensitive organic compound. The substrate is preferably made from a polyester film such as Mylar (a trademark of Dupont (UK) Ltd.) which has been coated with a thin layer of aluminum alloy which is electrically grounded. The belt is driven by means of motor 54 along a path defined by rollers 49, 50 and 52, the direction of movement being counter-clockwise as viewed and as shown by arrow 16. Initially a portion of the belt 10 passes through a charge station A at which a corona generator 48 charges surface 12 to a relatively high, substantially uniform, potential. A high voltage power supply 50 is coupled to device 48.

Next, the charged portion of photoconductive surface 12 is advanced through exposure station B. At exposure station B, ROS 56 lays out the image in a series of horizontal scan lines with each line having a specified number of pixels per inch. The ROS includes a laser having a rotating polygon mirror block associated therewith. The ROS imagewise exposes the charged photoconductive surface 12. After the electrostatic latent image has been recorded on photoconductive surface 12, belt 10 advances the latent image to development station C as shown in FIG. 3. At development station C, a development system or developer unit 34, develops the latent image recorded on the photoconductive surface. The chamber in the developer housing stores a supply of developer material. The developer material may be a one component developer material consisting primarily of toner particles. The developer material may be a custom color consisting of two or more different colored dry powder toners.

Again referring to FIG. 3, after the electrostatic latent image has been developed, belt 10 advances the developed image to transfer station D, at which a copy sheet 64 is advanced by roll 62 and guides 66 into contact with the developed image on belt 10. A corona generator 68 is used to spray ions on to the back of the sheet so as to attract the toner image from belt 10 to the sheet. As the belt turns around roller 49, the sheet is stripped therefrom with the toner image thereon.

After transfer, the sheet is advanced by a conveyor (not shown) to fusing station E. Fusing station E includes a heated fuser roller 71 and a back-up roller 72. The sheet passes between fuser roller 71 and back-up roller 72 with the toner powder image contacting fuser roller 71. In this way, the toner powder image is permanently affixed to the sheet. After fusing, the sheet advances through chute 74 to catch tray 75 for subsequent removal from the printing machine by the operator.

After the sheet is separated from photoconductive surface 12 of belt 10, the residual developer material adhering to photoconductive surface 12 is removed therefrom by a rotating fibrous brush 78 at cleaning station F in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
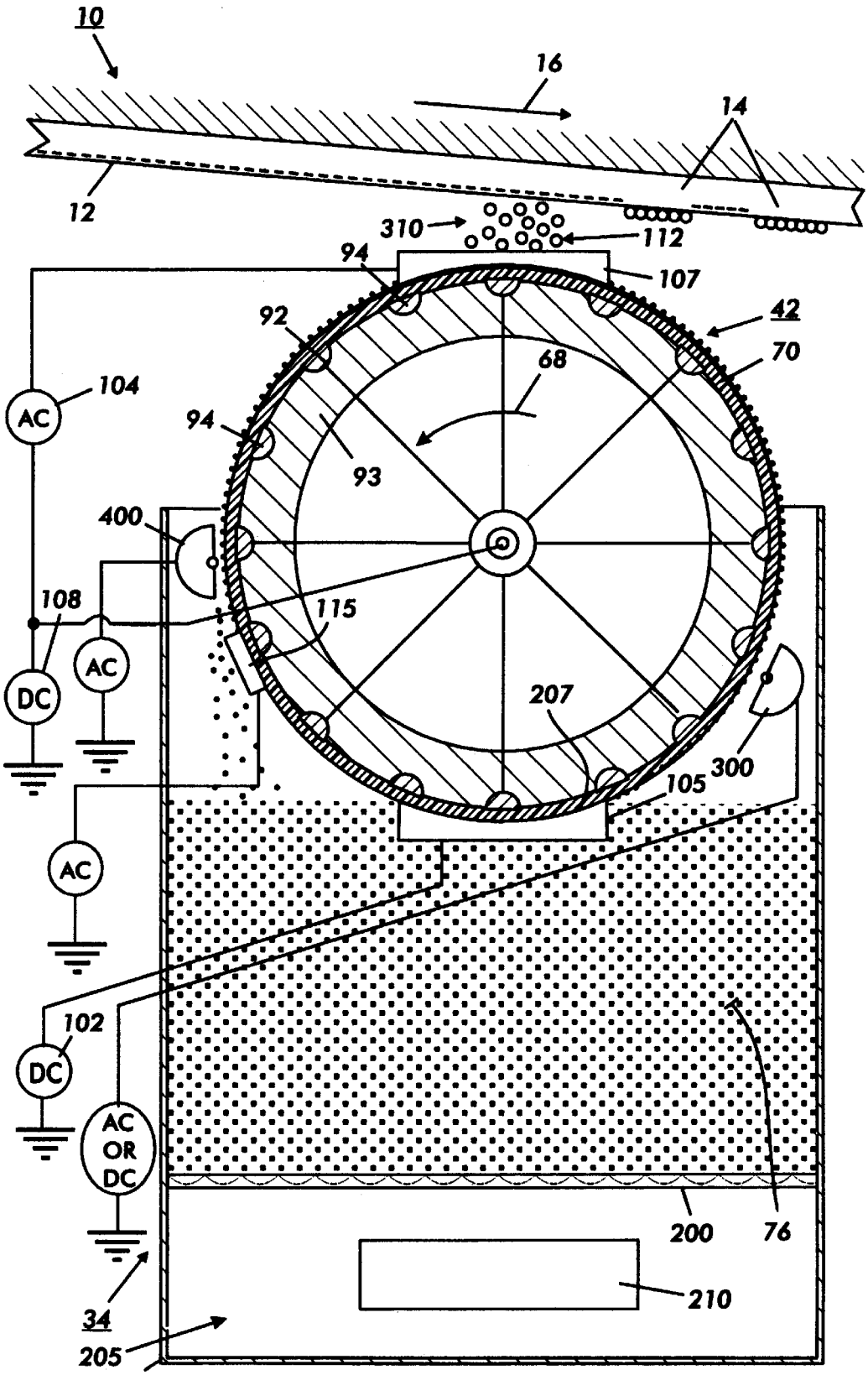
FIG. 1 is a schematic illustration of the development system according to the present invention.

Referring now to FIG. 1 in greater detail, development system 34 includes a housing defining a reservoir 76 for storing and fluidizing a supply of toner therein. The bottom of this fluidizing reservoir is comprised of a porous plate 200, with pore size of 5 microns or less, which allows gas to flow from plenum 205 to reservoir 76 but contains the toner in the reservoir. Gas (air) is supplied to the plenum through an opening 210 below the porous plate. The gas flow may be constant or may be modulated in time, enabling easier fluidization of the toner. As an additional aid to fluidizing the toner, the reservoir 76 may be vibrated (not shown). Although the toner in reservoir 76 exists in an approximately charge neutral state, it is known that the particles possess small amounts of negative or positive net charge.

Donor structure 42, which may be in the form of a roll or a continuous belt, is comprised of at least two sets of closely spaced interdigitated electrodes 92 and 94, which are be covered by an electrically relaxable overcoat 70. One set of electrodes 92 is connected together (commons), while the other set 94 is addressable individually (actives). The surface of donor structure 42 is in contact with or near the surface of the fluidized toner bed in reservoir 76. By applying a DC bias 102 between adjacent sets of electrodes 92 and 94, via a conducting brush commutator 105, fringe fields of approximately 0.2 to 0.3 volts/micron are established between the sets of electrodes in loading zone 207, enabling gentle and controllable loading of uncharged toner onto the surface of donor roll 42.

The thickness of the deposited toner layer can be controlled by the DC bias 102 between the sets of interdigitated electrodes 92 and 94. This microfield loading scheme takes advantage of the native toner charge distribution of the particles in the fluidized bed reservoir 76, which has some small width about zero charge. The combination of the fluidized bed reservoir, which presents essentially free uncharged toner particles to the donor, with the localized fields at the donor surface allows the slight net charges on the particles (both positive and negative) to be used to pick up toner onto the donor 42.

As the donor 42 rotates in the direction of arrow 68, the layer of uncharged toner on its surface is brought under corona charging device 300, where the toner is charged to an average Q/M ratio of from −30 to −50 microCoulombs/gram. Corona device 300 may be in the form of an AC or DC charging device (e.g. scorotron). As donor 42 is rotated further in the direction indicated by arrow 68, the now charged toner layer is moved into development zone 310, defined by the gap between donor 42 and the surface of the photoreceptor bet 10. Toner is released from the surface of the donor 42, forming a toner cloud 112, and imagewise develops the electrostatic latent image 14 on photoreceptor 10.

The separation of the toner loading and toner charging steps, as described here, is highly advantageous, allowing independent control over the amount of the thickness of the uncharged toner layers as well as the charge level and charge distribution of the toner particles after exposure to charging device 300. As mentioned previously, it has been found that the charging of toner layers on the donor after loading onto a donor avoids difficulties associated with placing the charging device in the fluidized bed of toner. In previous disclosures, it has been found that corona devices embedded in the fluidized toner necessarily generate high electric fields which exert strong forces on even slightly charged toner particles, causing violent instabilities in the toner bed. These instabilities cause non-uniformities in the deposited toner layers which must be eliminated before the toner is developed to an image. The separate charging of the toner in layers, as described here, may sacrifice some of the charge uniformity on the particles that is possible when charging is performed by immersing a corona device in the fluidized bed. However, charge spectrograph data and developability experiments suggest that any differences between the two methods, either in charging uniformity or particle adhesion, are small; charging in layers retains the general low adhesion benefits of ion charging.

Due to the gentle loading of toner in loading zone 207 and ion charging by corona device 300, which both act to keep toner adhesion to donor 42 low, the charged toner in development zone 310 is capable of releasing from the donor solely due to the DC electric field in the development zone. This DC field is provided by both the DC bias of from 0 to 1000 volts from power supply 108, applied to both sets of electrodes 92 and 94 via commutator 107 (similar to commutator 105), and the latent image 14 on photoconductor 10. To provide enhanced toner release, which enables higher toner delivery rates and increased development speed, an AC bias can be applied between adjacent sets of donor electrodes 92 and 94 in development zone 310. In FIG. 1, this AC bias is supplied by power supply 104 via commutator 107. When the AC fringe field is applied to a toner layer via an electrode structure in close proximity to the toner layer, the time-dependent electrostatic force acting on the charged toner momentarily breaks the adhesive bond to cause toner detachment and the enhancement of the powder cloud 112. The enhancement in developed toner mass from this optional use of AC during development has been measured to be approximately 20%.

Further rotation of donor 42 brings any residual (undeveloped) toner on the donor roll under AC corona device 400, where it is brought to a charge neutral state, removed from the donor and returned to the fluidized bed reservoir 76. Stripping of toner is facilitated by applying an AC bias between the sets of electrodes 92 and 94 via commutator 115. Alternatively, a blade (not shown) may be used to remove the toner from the donor 42. Complete stripping ensures erasure of all history of previous development and loading on the donor, eliminating the possibility of "ghosting". In addition, the return of unused toner in a charge neutral state maintains a steady native charge distribution in the fluidized bed, minimizing fluctuations in layer thickness during the initial loading step which may result from a significant net charge on the toner in the reservoir.

As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser. In this manner, a substantially constant amount of toner particles are in the fluidizing reservoir of the developer housing.

Figure 2:
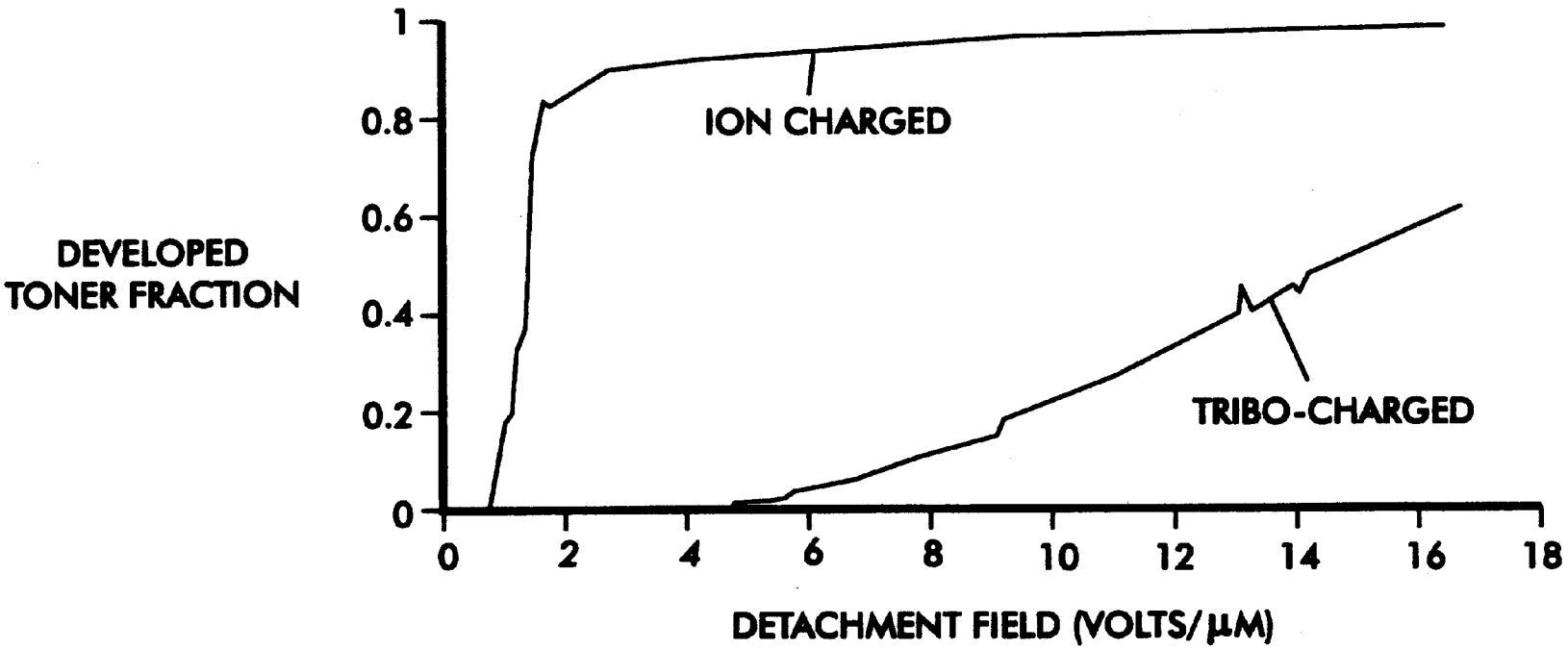
FIG. 2 is a graph comparing Developed Toner Fractions for toner which has been ion charged and toner which has been charged triboelectrically.

Applicants have used electric field detachment to measure charged particle adhesion for both tribo-charged and ion charged toners. In these studies, an electric field is applied to move charged toner from a donor to a receiver. The receiver is equipped with an optical sensor to detect the amount of toner developed as a function of applied field, giving a direct measure of the adhesion of the particles on the donor. The advantages of using ion charged toner can be seen in the experimental electric field detachment data of FIG. 2. Ion charged toner particles develop to the receiver far more easily and completely than identical triboelectrically charged particles with approximately the same total charge. The average charge to mass ratios for both toner samples was approximately −20 microCoulombs/gram. This is direct evidence of the dramatically reduced adhesion possible with ion charged toner from an invention as described above.

It has been found that toner charging by exposure to corona in the manner just described is also advantageous because the resulting particle charge is, to a great degree, independent of the material properties of the pigment contained in the toner. This is not the case, for example, with triboelectric charging, which is known to be highly dependent on the type and quantity of pigment in the toner. The pigment independence of ion charging, combined with the use of a fluidized bed as a toner reservoir, enables the blending of two or more dry powder toners of different colors to achieve custom color development. Since, in the present invention, the charge distribution of the neutral toner in the fluidized bed influences the fringe field loading onto the donor, it is desirable in the case of a blend of toners that the charge distributions of the different constituents overlap to a significant degree. In practice, it has been found that this condition is easy to satisfy with the proper pigment and external additive choices.

It should be evident by one skilled in the art that the single color printing process described above can be modified to allow xerographic printing of more than one color. For example, tandem printing architecture is one such modification, in which each color has its own complete marking station, including photoconductor, exposure device, and development, transfer and cleaning subsystems. After development of the electrostatic latent image, the color separations are transferred to a medium, which could be paper or some intermediate belt, where the full color image is successively built up. Another example, image-on-image (IOI) mode of printing is another possible architecture, in which the full image, made up of the two or more color separations, is built up on a single photoconductor and later transferred to paper in a single transfer step. The IOI architecture is the less forgiving of the two architectures, as it demands that each successive development step not disturb the previous toner image on the photoconductor. Development systems which possess these qualities are often termed scavengeless.

Due to the low adhesion of ion charged toner and the easier release of such toner from a development system such as described above, ion chargingbased development is expected to be scavengeless in nature, and thus highly desirable for IOI printing. Low toner adhesion from ion charging also has other benefits, which apply to both the tandem as well as the IOI architectures, such as the ability to deliver small particles for high quality images and the possibility of higher toner delivery rates to enable higher speeds. As mentioned previously, the ability to blend toners for custom color is yet another important attribute of ion charging-based development systems. The ability to perform custom color development, resulting from the pigment independence of ion charging, benefits both tandem and IOI xerographic printing.

An additional advantage of the present invention that it allows for movement of toner with electrical forces only, enabled by a donor with individually addressable electrodes. Reduced mechanical contact with the toner, as a result of the absence of carrier beads for charging and the abandonment of metering and charging blades in the current proposal, enables longer toner life. This is especially important during operation with low toner throughput (low area coverage documents, for example), where toner residence times in the development system can be long. In addition, failure of the charging system due to degradation of the triboelectric charging member (ie, carrier or charging blades) is avoided.

In summary, there is provided a development system of the present invention that utilizes independently controlled non-contact metering and ion charging of toner. The resulting toner delivery system is designed to produce charged, low adhesion toner and present it gently to an electrostatic latent image in the form of a toner cloud.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface, comprising:

a housing defining a reservoir storing a supply of developer material comprising toner;

means for fluidizing said developer material in the chamber of said housing;

a donor member, mounted partially in said chamber and spaced from the imaging surface, for transporting toner on an outer surface of said donor member to a region opposed from the imaging surface, said toner donor member having a plurality of electrodes positioned near the outer surface of donor member;

means for electrical biasing a portion of said electrode members on a region of said donor member positioned in close proximity to said fluidized toner so as to electrostatically load toner onto the region of the donor member;

means for ion charging said toner loaded on the region of said donor member;

means for electrical biasing said electrode members positioned in close proximity to said imaging surface to detach toner from said region of said donor member as to form a toner cloud for developing the latent image; and means for discharging and removing residual toner on the region of said donor and returning said toner to the reservoir.

2. The apparatus as recited in claim 1, wherein said fluidizing means includes:

a plenum for supplying air flow;

a porous plate positioned in said reservoir and in communication with said plenum, with air flowing from plenum to the reservoir, to fluidize the toner.

3. The apparatus as recited in claim 2, wherein the air flow to the reservoir is pulsed or modulated in time.

4. The apparatus as recited in claim 1, wherein the donor member includes an insulating substrate having two or more sets of closely spaced interdigitated electrodes, wherein each set is independently electrically biased with respect to the other(s).

5. The apparatus as recited in claim 4, wherein the sets of electrodes on said donor roll are covered by an electrically relaxable overcoat.

6. An apparatus as recited in claim 1, wherein said electrode members positioned in close proximity to said fluidized toner are biased with a DC electrical bias between adjacent electrodes.

7. The apparatus as recited in claim 1, wherein ion charging means comprises a DC or AC corona device located adjacent to the surface of said donor.

8. An apparatus as recited in claim 1, wherein said electrode members positioned in close proximity to said imaging member are biased with an AC bias between adjacent electrodes.

9. The apparatus as recited in claim 1, wherein said electrode members positioned in close proximity to said imaging surface are biased with a common DC bias between the imaging surface and the electrodes of said donor roll.

10. The apparatus as recited in claim 1, wherein an AC corona device is used to discharge residual toner on said donor member.

11. The apparatus as recited in claim 1, wherein an AC bias is applied between adjacent electrodes on said donor member for removing neutralized, residual toner, allowing said toner to return to the reservoir.

12. An apparatus as recited in claim 1, wherein the toner comprises a mixture of two or more different color toners.

* * * * *